US008097821B2

(12) United States Patent
Tatehata et al.

(10) Patent No.: US 8,097,821 B2
(45) Date of Patent: Jan. 17, 2012

(54) MOVABLE CONTACT UNIT WITH LIGHT-GUIDING FUNCTION AND LIGHTED PANEL SWITCH USING THE SAME

(75) Inventors: Naoki Tatehata, Kyoto (JP); Tsutomu Aisaka, Osaka (JP); Yousuke Chikahisa, Hyogo (JP)

(73) Assignee: Panasonic Corporation, Osaka (JP)

( * ) Notice: Subject to any disclaimer, the term of this patent is extended or adjusted under 35 U.S.C. 154(b) by 594 days.

(21) Appl. No.: 12/331,742

(22) Filed: Dec. 10, 2008

(65) Prior Publication Data

US 2009/0145733 A1 Jun. 11, 2009

(30) Foreign Application Priority Data

Dec. 11, 2007 (JP) ..... 2007-319167

(51) Int. Cl.
*H01H 9/00* (2006.01)

(52) U.S. Cl. ..... 200/314; 200/516

(58) Field of Classification Search ..... 200/314, 200/315, 516

See application file for complete search history.

(56) References Cited

U.S. PATENT DOCUMENTS 7,378,609 B1 * 5/2008 Fedorjaka ..... 200/516
7,605,338 B2 * 10/2009 Karaki et al. ..... 200/406

FOREIGN PATENT DOCUMENTS

CN 101211700 12/2007
JP 2007-053063 3/2007
JP 2008-181862 8/2008

* cited by examiner

*Primary Examiner* — Elvin Enad
*Assistant Examiner* — Lisa Klaus
(74) *Attorney, Agent, or Firm* — Wenderoth, Lind & Ponack, L.L.P.

(57) ABSTRACT

The movable contact unit with a light-guiding function has the following structure. An uneven section is formed in a section that is to be lighted on the lower surface of a TPU base sheet. A film with a refractive index of light lower than that of the base sheet is disposed beneath the lower surface of the base sheet in a manner that the uneven section is embedded in the film. Besides, an adhesive layer is disposed beneath the film so as to hold a movable contact. The movable contact unit structured above is effectively employed for a lighted panel switch capable of reducing loss in amount of light and providing the section that is to be lighted with required illuminance.

10 Claims, 1 Drawing Sheet

MOVABLE CONTACT UNIT WITH LIGHT-GUIDING FUNCTION AND LIGHTED PANEL SWITCH USING THE SAME

BACKGROUND OF THE INVENTION

1. Field of the Invention

The present invention relates to a movable contact unit with a light-guiding function for structuring the operation panel of electronic equipment and also relates to a lighted panel switch using the movable contact unit.

2. Background Art

Conventionally, key switches with a lighting function have frequently been used for an operation panel mounted on electronic equipment, such as a mobile phone or a handheld terminal. In such a lighting function, light of an LED directly illuminates keys on the panel or the light of an LED is guided to the keys through a light-guide sheet or the like.

FIG. 2 is a section view of part of a conventional input device. Circuit board 100 of FIG. 2 has central fixed contact 101 and peripheral fixed contact 102. Sheet material 110 is disposed on the upper surface of circuit board 100 via adhesive layer 111. Sheet material 110 and adhesive layer 111 form dome section 120 that protrudes upward in which dome-shaped movable contact 130 is accommodated. The circumferential end of dome-shaped movable contact 130 is mounted on peripheral fixed contact 102 in a manner such that the center of the dome faces central fixed contact 101 at an established interval. The upper surface of domed movable contact 130 is held by adhesive layer 111 disposed beneath sheet material 110. Sheet material 110 is a light-guide sheet of an insulation film, for example, made of polycarbonate. The light-guide sheet guides light incident from the side end and illuminates the upper side of the sheet.

Light-emitting device 150 is mounted on circuit board 100. The light of light-emitting device 150 comes in parallel with sheet material 110 that guides light. Taking the route of light into account, light-emitting section 151 is disposed opposite to the side end of sheet material 110. Transparent resin-member 160 gathers light from light-emitting section 151 and effectively guides the light incident from the side end of sheet material 110.

Next will be described the workings of such conventional input device. When dome section 120 is pushed with a predetermined magnitude of force, movable contact 130 disposed in dome section 120 bends down and makes contact with central fixed contact 101. This brings electrical connections between central fixed contact 101 and peripheral fixed contact 102 via movable contact 130, establishing the ON state of the switch. When the pushing force is removed, movable contact 130 returns to its original shape, i.e., the switch goes back to the OFF state (FIG. 2).

When light is emitted from light-emitting device 150 that is disposed at the side end of sheet material 110 as a light-guide sheet, the light is guided inside the light-guide sheet including the dome-shaped space formed by dome section 120, so that the upper side of sheet material 110 is illuminated. The structure above has greatly increased ease of operation; when input keys having letters and symbols marked thereon made of light-transmissive material are disposed on sheet material 110, they are easily recognized, particularly in the dark. For example, Japanese Unexamined Patent Application Publication No. 2007-53063 is known as a patent document relating to the structure above.

According to the conventional input device, as described above, a light-guide sheet, i.e., sheet material 110 is disposed along the domed shape of movable contact 130. At the same time, adhesive layer 111, which is used as the adhesive layer for circuit board 100, is disposed on the lower surface of sheet material 110. If difference in refractive index of light between adhesive layer 111 and sheet material 110 is small, the light traveling through sheet material 110 passes at the interface between adhesive layer 111 and sheet material 110, thereby increasing the loss in amount of light at the interface between the adhesive layer and circuit board 100. Moreover, the light travelling through adhesive layer 111 is absorbed or scatters inside adhesive layer 111, thereby increasing the loss in amount of light. In some cases, the reflected or scattered light inconveniently leaks on the upper side of sheet material 110, resulting in poor illuminance in the operation panel that is to be lighted. Even in the structure where adhesive layer 111 is partly removed, if sheet material 110 makes contact with circuit board 100 or movable contact 130, the light traveling through sheet material 110 reflects or scatters at the interface between adhesive layer 111 and sheet material 110, thereby increasing the loss in amount of light at the interface.

SUMMARY OF THE INVENTION

The present invention provides a movable contact unit with a light-guiding function and a lighted panel switch using the movable contact unit. In spite of having an adhesive layer disposed beneath a base sheet as a light-guide sheet so as to hold a movable contact, the structure of the present invention reduces the loss in amount of light, providing the section that is to be lighted with required illuminance.

The movable contact unit with a light-guiding function is formed of a push-input type movable contact made of a thin metal plate and a base sheet made of an insulating film. The movable contact upwardly protrudes so as to form a domed shape. Having an adhesive layer on the lower surface, the base sheet is disposed along the domed shape of the movable contact so as to hold the movable contact by the adhesive layer. At the same time, the base sheet guides light emitted from a light source disposed in the side direction and illuminates the upper side of the base sheet. Besides, in the structure of the present invention, a film having a refractive index of light lower than that of the base sheet is disposed between the base sheet and the adhesive layer.

The structure described above, where a film having a refractive index of light lower than that of the base sheet is disposed between the base sheet and the adhesive layer, prevents light from escaping from the base sheet as compared with the conventional one. That is, the structure suppresses leakage of light from sections with no need of being lighted and reduces the loss in amount of light, providing the section that is to be lighted with required illuminance, compared with the conventional structure.

The present invention also provides a lighted panel switch employing the movable contact unit with a light-guiding function described above. In the structure, the movable contact unit with a light-guiding function is disposed on a predetermined position on a circuit board having a fixed contact so as to form a discrete switch. In spite of having a simple structure, the lighted panel switch reduces the loss in amount of light, providing the section that is to be lighted with required illuminance.

DETAILED DESCRIPTION OF THE INVENTION

Figure 1:
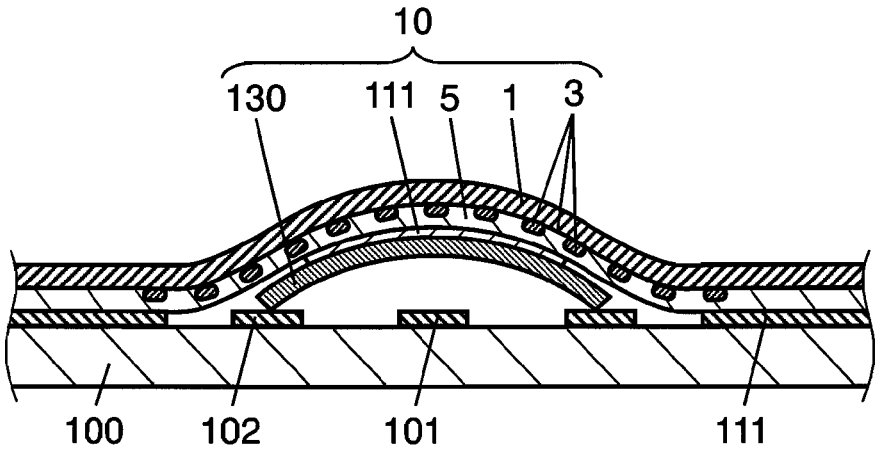
FIG. 1 is a section view of a lighted panel switch having a movable contact unit with a light-guiding function in accordance with an exemplary embodiment of the present invention.
Figure 2:
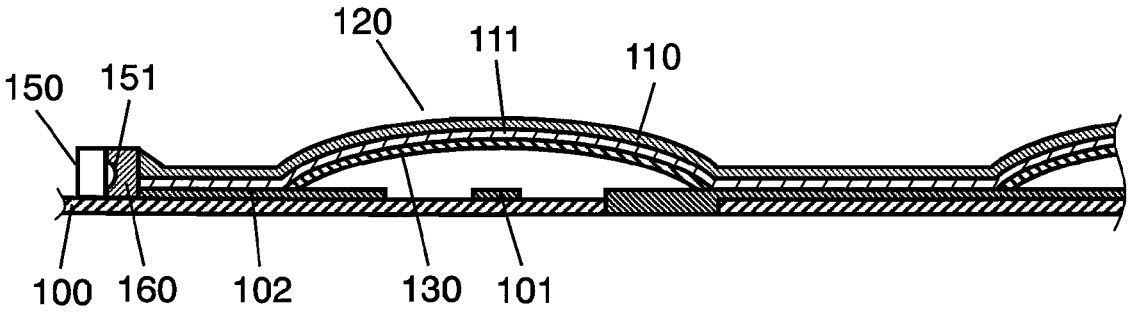
FIG. 2 PRIOR ART
FIG. 2 is a partial section view of a conventional input device.

The exemplary embodiment of the present invention is described hereinafter with reference to the accompanying drawings. In the drawings, like parts are identified by the same reference numerals as in the conventional structure and the detailed description thereof will be omitted.

Exemplary Embodiment

FIG. 1 is a section view of a lighted panel switch having the movable contact unit with a light-guiding function in accordance with the exemplary embodiment of the present invention. Base sheet 1 of FIG. 1 is an insulating film formed as a light-guide sheet. The following materials are employed for base sheet 1: polyurethane; polyethylene terephthalate (PET); polycarbonate; and silicone. The description will be given below of base sheet 1 of an insulating film made of thermoplastic polyurethane (hereinafter, TPU). TPU exhibits an excellent flexibility in polyurethane having a refractive index of light ranging from 1.50 to 1.60.

TPU base sheet 1 has uneven section 3, which has a plurality of small-diameter dots formed by printing. Uneven section 3 is disposed directly on the lower surface of base sheet 1 where movable contact 130 is held, i.e., the section that needs to be illuminated. By virtue of this structure, light guided into the section of base sheet 1, where movable contact 130 is held, illuminates upward. The printed small-diameter dots are preferably formed of a material in which filler having fine particles of titanium dioxide, barium titanate or silica is mixed in polyester or urethane-acrylate.

This structure makes possible the upper surface lighting, even when the refractive index of uneven section 3 is lower than that of base sheet 1. However, it is desirable that the refractive index of uneven section 3 is substantially equal to or higher than that of base sheet 1 for improving the lighting efficiency. Moreover, mixing filler having fine particles composed of inorganic oxide such as titanium dioxide, barium titanate or silica with uneven section 3 improves the lighting efficiency by scattering.

Besides, for example, film 5 made of fluorine-containing resin is disposed all over the lower surface of base sheet 1 and uneven section 3 is embedded in film 5. The refractive index of fluorine-containing resin film 5 ranges from 1.35 to 1.40, which is lower than that of base sheet 1.

Adhesive layer 111 is formed beneath film 5 so as to hold upward the domed section of movable contact 130. FIG. 1 shows the section of base sheet 1 that faces the domed section of movable contact 130, which needs to be illuminated.

Movable contact unit 10 with a light-guiding function of the present invention is structured as described above. When movable contact unit 10 is mounted on circuit board 100 with adhesive layer 111, as shown in FIG. 1, the structure serves as a simple lighted-panel-switch.

According to movable contact unit 10 with a light-guiding function, electrical connection/disconnection between central fixed contact 101 and peripheral fixed contact 102 via movable contact 130 allows movable contact unit 10 to work as a discrete push-type switch. Light-emitting section 151 of light-emitting device 150 (not shown in FIG. 1) mounted on circuit board 100 is disposed opposite to the side end of base sheet 1.

Next will be described the workings of the lighted panel switch having movable contact unit 10 with a light-guiding function of the embodiment.

When a pushing force is applied onto the domed section of base sheet 1, the center part of movable contact 130 bends down and makes contact with central fixed contact 101. This brings electrical connections between central fixed contact 101 and peripheral fixed contact 102 via movable contact 130 whose circumferential end makes contact with peripheral fixed contact 102, so that the switch goes into the ON state. When the pushing force is removed, movable contact 130 returns to its original shape and the center part thereof goes away from central fixed contact 101. That is, the switch goes back to the OFF state (see FIG. 1).

When light is emitted from light-emitting section 151 of light-emitting device 150, the light is introduced into base sheet 1 from the side edge surface of base sheet 1, and propagates inside. In the structure above, base sheet 1 is formed of a material with a refractive index of light ranging from 1.50 to 1.60. That is, base sheet 1 is placed between the air with a refractive index of 1.00 and fluorine-containing resin film 5 with a low refractive index ranging from 1.35 to 1.40. The structure allows the light to be confined inside base sheet 1, reducing the light reaching adhesive layer 111, thereby preventing unwanted reflected light and scattered light, and lessening the loss in amount of light, compared with the conventional structure where the adhesive layer is directly formed beneath base sheet without a film with a low refractive index.

Adhesive layer 111 is made of silicone-based material whose refractive index ranges from 1.42 to 1.45 or acrylic material whose refractive index ranges from 1.49 to 1.54. Placing film 5 whose refractive index of light ranges from 1.35 to 1.40 between base sheet 1 whose refractive index ranges from 1.50 to 1.60 and adhesive layer 111 increases the difference in refractive index of light between base sheet 1 and adhesive layer 111. This effectively reduces leakage of light from base sheet 1 toward adhesive layer 111. That is, the structure reduces reflected light and scattered light at the interface between base sheet 1 and adhesive layer 111 or between base sheet 1 and circuit board 100, preventing unwanted reflected light and scattered light from leaking on the upper side of base sheet 1. Moreover, the structure reduces the light leaking inside adhesive layer 111 and the absorption and scattering of the light inside adhesive layer 111, thereby lowering the loss in amount of light.

In the structure above, the light guided onto base sheet 1 is scattered at uneven section 3 and illuminates the upper section of base sheet 1. By virtue of the light guide with little loss in amount of light, required illuminance can be easily obtained.

According to the structure shown in FIG. 1, the small-diameter dots of uneven section 3, since being disposed along the domed section of movable contact 130, are subject to stress from application of pushing force repeatedly carried out in the push-input operation. However, film 5 is formed in a manner that uneven section 3, which is formed beneath base sheet 1, is embedded therein, so that uneven section 3 is protected by film 5. Moreover, the structure can improve durability even when uneven section 3 does not stick to base sheet 1 firmly and does not endure strong pressing on a switch.

When the light reflects or scatters at uneven section 3, the light also goes in the direction of the lower side of uneven section 3. In the structure shown in FIG. 1, refractive index of film 5 is lower than that of base sheet 1. Refractive index of uneven section 3 is substantially equal to or higher than that of base sheet 1 and refractive index of film 5 is lower than uneven section 3. In this way, uneven section 3 is embedded in film 5. Therefore, this structure contributes to decrease the loss of light that goes in the direction of the lower side of uneven section 3 due to the lower refraction index of film 5 than that of uneven section 3, thereby lighting the upper surface of base sheet 1 more brightly.

In a structure where uneven section 3 is formed on the upper side of base sheet 1, uneven section 3 has no protection by film 5. However, the structure decreases unwanted leakage of light from the lower side, because refractive index of film 5 is lower than that of base sheet 1, thereby reducing the light leaking in the lower direction of base sheet 1 as compared with the conventional structure.

As described above, movable contact unit 10 with a light-guiding function and a lighted panel switch having movable contact unit 10 suppress leakage of light in spite of its simple structure, so that required illuminance is provided to the section that is to be lighted.

Although TPU is employed for base sheet 1 in the embodiment, it is not limited thereto; base sheet 1 may be made of a different material of urethane, or may be made of the following materials used as a light-guide sheet: polycarbonate insulating film of refractive index: 1.58-1.60; polyethylene terephthalate insulating film of refractive index: 1.53-1.57; and silicone insulating film of refractive index: 1.42-1.45. In that case, too, disposing film 5 beneath the aforementioned material offers a similar effect.

Film 5 is not necessarily formed of fluorine-containing resin. In that case, film 5 should be formed of a material whose refractive index has a large difference from that of a material to be applied for base sheet 1. Besides, film 5 should preferably be formed into a structure in a manner that uneven section 3 is covered. Although uneven section 3 described in the embodiment is formed by printing as an easy and simple way, other methods can be employed for forming uneven section 3.

Although movable contact 130 in the embodiment has a domed shape, i.e., the outer shape is circular or oval; it is not limited thereto and may be formed differently. Besides, the push-type switch having the aforementioned movable contact is not necessarily formed into the structure described earlier.

The movable contact unit with a light-guiding function and a lighted panel switch using the movable contact unit of the present invention offer an advantageous effect. In spite of having an adhesive layer disposed beneath a base sheet formed of a light-guide sheet so as to hold a movable contact, the structure reduces the loss in amount of light, providing the section that is to be lighted with required illuminance. The movable contact unit and the lighted panel switch are useful for structuring an input operation panel of electronic equipment.

What is claimed is:

1. A movable contact unit with a light-guiding function, comprising:

a push-input type movable contact made of a metallic thin plate that is formed into an upwardly protruded dome shape; and a base sheet made of an insulating film disposed along the domed shape of the movable contact, which holds the movable contact by an adhesive layer disposed on a lower surface of the base sheet and guides light emitted from a light source disposed at a side position to illuminate an upper side of the base sheet, wherein, a film whose refractive index of light is lower than a refractive index of light of the base sheet is disposed between the base sheet and the adhesive layer.

2. The movable contact unit with a light-guiding function of claim 1, wherein an uneven section is disposed in a section, where the film lies beneath the base sheet, on an upper surface or a lower surface of the base sheet so as to guide light upward.

3. The movable contact unit with a light-guiding function of claim 2, wherein a refractive index of the uneven section is substantially equal to or higher than the refractive index of the base sheet.

4. The movable contact unit with a light-guiding function of claim 3, wherein the uneven section and the film are disposed on a lower surface of the base sheet, and the uneven section is covered with the film.

5. A lighted panel switch comprising:

the movable contact unit with a light-guiding function, according to claim 4, wherein the movable contact unit is disposed on a predetermined position on a circuit board having a fixed contact so as to form a discrete switch.

6. A lighted panel switch comprising:

the movable contact unit with a light-guiding function, according to claim 3, wherein the movable contact unit is disposed on a predetermined position on a circuit board having a fixed contact so as to form a discrete switch.

7. The movable contact unit with a light-guiding function of claim 2, wherein the uneven section and the film are disposed on a lower surface of the base sheet, and the uneven section is covered with the film.

8. A lighted panel switch comprising:

the movable contact unit with a light-guiding function, according to claim 7, wherein the movable contact unit is disposed on a predetermined position on a circuit board having a fixed contact so as to form a discrete switch.

9. A lighted panel switch comprising:

the movable contact unit with a light-guiding function, according to claim 2, wherein the movable contact unit is disposed on a predetermined position on a circuit board having a fixed contact so as to form a discrete switch.

10. A lighted panel switch comprising:

the movable contact unit with a light-guiding function of claim 1, wherein the movable contact unit is disposed on a predetermined position on a circuit board having a fixed contact so as to form a discrete switch.

* * * * *